United States Patent [19]

Angelucci et al.

[11] Patent Number: 5,042,734

[45] Date of Patent: Aug. 27, 1991

[54] DRIVE ROLL ASSEMBLY FOR STRAND WINDING APPARATUS

[75] Inventors: Richard J. Angelucci, Springfield, Pa.; Thomas W. Manning, Jr.; James F. McKinney, both of Waynesboro, Va.; William D. Walker, Landenberg, Pa.

[73] Assignee: E. I. Du Pont de Nemours and Company, Wilmington, Del.

[21] Appl. No.: 515,402

[22] Filed: Apr. 27, 1990

[51] Int. Cl.[5] ..... B65H 54/46

[52] U.S. Cl. ..... 242/18 DD

[58] Field of Search ..... 242/18 DD, 18 R, 46.2, 242/46.3, 46.4, 18 A, 46.5, 46.6

[56] References Cited

U.S. PATENT DOCUMENTS

| | | | |
|---|---|---|---|
| 2,647,701 | 8/1953 | Cannard | 242/68 |
| 3,165,274 | 6/1965 | De Priest | 242/18 |
| 3,342,428 | 9/1967 | Smiley | 242/18 |
| 3,409,238 | 11/1968 | Campbell et al. | 242/18 |
| 3,701,490 | 10/1972 | Wray | 242/18 DD |
| 3,813,051 | 5/1974 | Miller | 242/46.4 |
| 3,825,195 | 7/1974 | Miller | 242/18 DD |
| 4,232,835 | 11/1980 | Benin | 242/46.4 |
| 4,398,676 | 8/1983 | Koppen et al. | 242/18 A |

*Primary Examiner*—Stanley N. Gilreath

[57] ABSTRACT

An improved cantilevered lay-on drive roll assembly is provided for high speed winding of threadlines on separable yarn packages which are supported on a common cantilevered chuck. The assembly has a deflectable coupling which connects the drive shaft to the roll shell and spaced bearings for rotating the shell on a cantilevered support.

5 Claims, 7 Drawing Sheets

DRIVE ROLL ASSEMBLY FOR STRAND WINDING APPARATUS

BACKGROUND OF THE INVENTION

1. Field of the Invention

This invention relates to a cantilevered drive roll assembly for high speed winding of a plurality of threadlines on an equal number of separable yarn packages which are supported on a common cantilevered chuck, the yarn packages being rotated by direct contact of the drive roll surface with the periphery of the packages. Such rolls are known as lay-on drive rolls. More particularly, the invention concerns an improved drive roll assembly having a deflectable coupling connecting the drive shaft to the roll shell and spaced bearings for rotating the shell on a cantilevered support.

2. Description of the Prior Art

U.S. Pat. Nos. 4,398,676 (Koppen et al.), 3,701,490 (Wray), 3,409,238 (Campbell et al.), 3,342,428 (Smiley), 3,165,274 (De Priest) and others disclose apparatus for high speed winding a plurality of threadlines on an equal number of separable yarn packages supported on a common cantilevered roll. The yarn packages are rotationally driven by cantilevered lay-on drive rolls. It is desired to increase the winding capacity of such existing machines by lengthening the rolls to permit a larger number of yarn packages to be formed on the rolls. However, to increase the length of the drive rolls of such winders usually requires a substantial increases in roll diameter as well, in order to achieve high speed operation without excessive vibration. Increasing the diameter of the drive roll is not desirable. The additional space required by a larger drive roll could readily reduce the number of rolls that could fit the existing winding apparatus and thereby eliminate the productivity gains associated with the added length.

Other driven-roll assemblies are known. For example, U.S. Pat. No. 3,813,051 (Miller) discloses a driven bobbin chuck supported by spaced bearings on a cantilevered support and driven by a central shaft with a non-circular coupling. U.S. Pat. No. 2,647,701 (Cannard) discloses a bobbin chuck that axially compresses an elastomeric ring to achieve radial gripping of the bobbin. U.S. Pat. 4,232,835 (Benin) discloses a bobbin chuck that axially moves tapered camming surfaces to achieve radial gripping of the bobbins.

An object of this invention is to provide an improved drive roll assembly of increased drive roll length but not of increased drive roll diameter, to permit corresponding increases in the length and/or number of the yarn packages that can be wound up, thereby increasing windup capacity of the winding apparatus.

SUMMARY OF THE INVENTION

The present invention provides an improved drive roll assembly that is particularly suited for high speed winding of a plurality of threadlines on an equal number of separable yarn packages which are supported on a common cantilevered chuck and are rotated by direct contact of the drive roll surface with the periphery of the packages. The drive roll assembly is of the known type that has (a) an elongated tubular shell having a cylindrical inner surface and an outer drive surface, (b) an elongated tubular support fitting which extends coaxially inside one end of the shell for a portion of the fitting length, said fitting having an inboard end which is adapted for cantilevered attachment to a supporting wall of a winding apparatus and (c) a drive shaft coaxially located inside the support fitting and having an outboard portion that extends into a portion of the tubular shell, the shaft extending from outside the inboard end of the support fitting to the outboard end of the support fitting and being supported radially at least at the inboard end of the fitting. The improvement of the present invention comprises two spaced bearings rigidly mounted on the inner surface of the shell and contacting the outer surface of the support fitting for rotating the shell on the support and a deflectable coupling located inside the shell, attached to the outboard end of the drive shaft and having an outer surface that frictionally engages a portion of the inner surface of the tubular shell. Preferably the drive roll further comprises means for applying an axial force between the coupling and the end of the shaft to develop radial forces between the inner surface of the shell and the outer surface of the coupling. Usually, the outboard end of the drive shaft has a tapered outer surface and a threaded portion, and the coupling has a tapered bore which is mated with the tapered outer surface of the drive shaft, and held in place by a nut that engages said threaded portion of the drive shaft.

In a preferred embodiment of the drive roll assembly the coupling has radial cuts that extend along a major fraction of the length of the coupling and form deflectable segments with an outer diameter substantially equal to the diameter of a portion of the inner surface of the shell, and the coupling bore has a steep machine taper matching the taper of the outboard end of the drive shaft. In another embodiment, the deflectable coupling comprises a collar having a shoulder on which is seated an annular elastomeric ring and a compression plate which bears against the elastomeric ring and the nut forces the plate against the ring thereby forcing the elastomer into pressing frictional engagement with the collar and the shell inner surface.

BRIEF DESCRIPTION OF THE DRAWINGS

The invention will be better understood by referring to the attached drawings, in which.

DETAILED DESCRIPTION OF PREFERRED EMBODIMENTS

Figure 1:
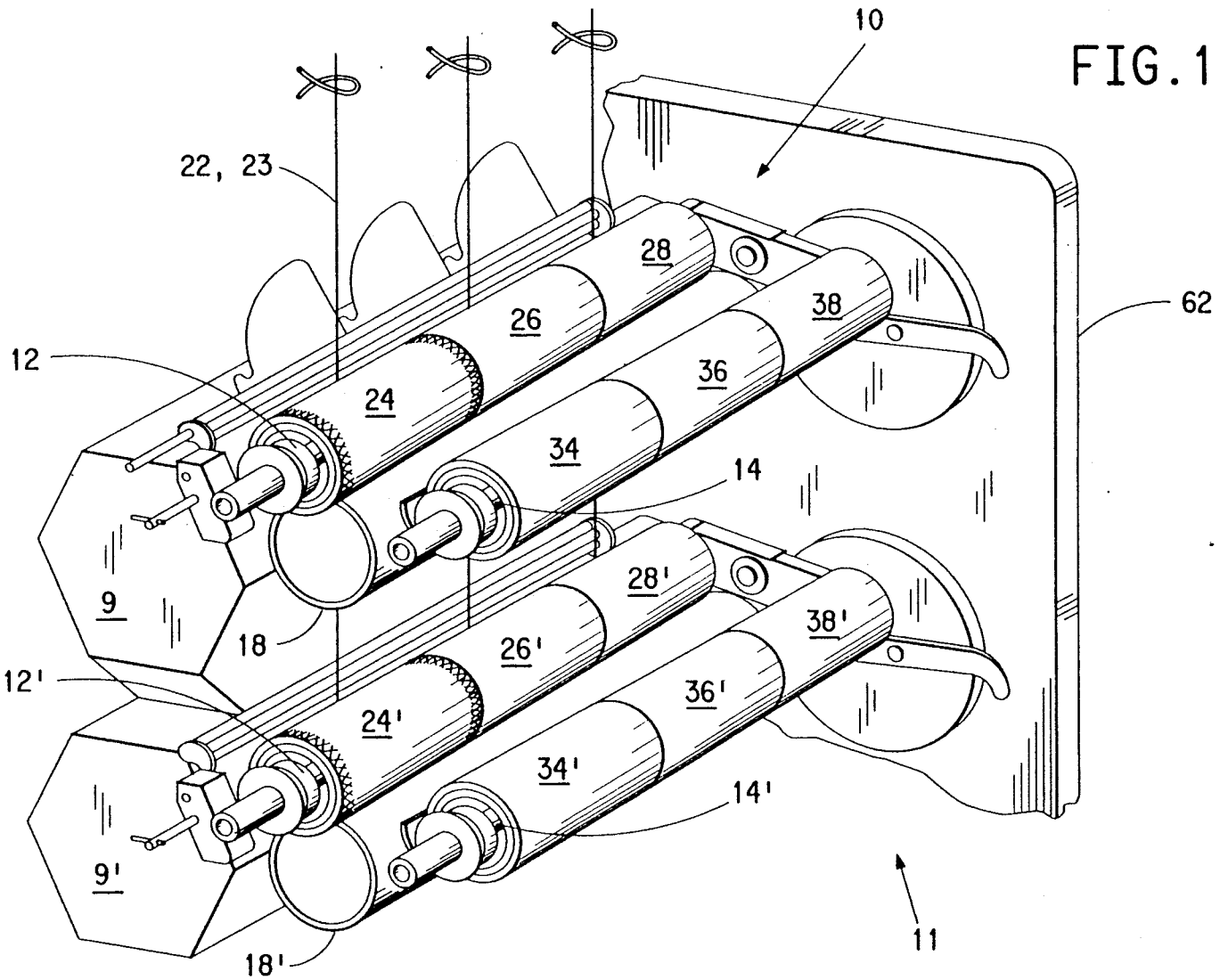
FIG. 1 is a perspective view of a winder apparatus having a plurality of lay-on roll windups on a single frame.

The windup apparatus selected for illustrating the invention is of the known type depicted in FIG. 1. A detailed description of the apparatus and its operation is given in U.S. Pat. No. 4,398,676 (Koppen et al.) in column 2, line 9, through column 3, line 19, which description is hereby incorporated herein by reference.

The drive roll assembly of the present invention increases the capacity of winders of the type described in U.S. Pat. No. 4,398,676. When the drive roll assemblies of the present invention are used, the chucks of the winders can be extended in length about 35% for mounting additional yarn packages, thereby increasing the winding capacity of the windup apparatus. The particular coupling used for connecting the drive shaft to the roll shell and the specific location of the bearings that support the roll in the drive roll assembly are believed to be features of the invention that permit the productivity increase.

FIG. 1 depicts an overall arrangement of a typical lay-on roll winder. Two windups one above the other are shown. It is preferred that there are two more windups in mirror image positions on the other side of mechanisms 9 and 9' which mechanisms are shared by pairs of windups. There are four lay-on drive rolls, two (18 and 18') on either side of the winder mechanisms 9 and 9'. Each upper and lower pair of drive rolls is driven simultaneously by a single motor through an arrangement of belts and pulleys (not shown). One half of the winder comprising windups 10 and 11 is shown in FIG. 1. Twelve packages are shown being wound on this half, three on each chuck; e.g., packages 24, 26, and 28 on chuck 12, and packages 24', 26', and 28' on chuck 12'. Yarn lines, such as 22 and 23, go to the upper and lower windups respectively. Chucks 14 and 14' are in a ready position with empty tube cores 34, 36, 38, and 34', 36', 38', respectively. The chucks on the windup can be modified and extended to hold, for instance, four packages, but this creates a problem in that the cantilevered lay-on drive rolls 18 and 18', if lengthened, deflect excessively and cause undesirable vibration levels within the usual operating speeds of the winder. Increasing the diameter of the drive roll is not a desirable way to resolve these problems because the additional space occupied by the larger drive rolls would reduce the number of drive rolls which could be fitted into the same space on the existing winding machines. This would cancel out the productivity gains to be achieved by adding a package to each chuck.

Figure 2:
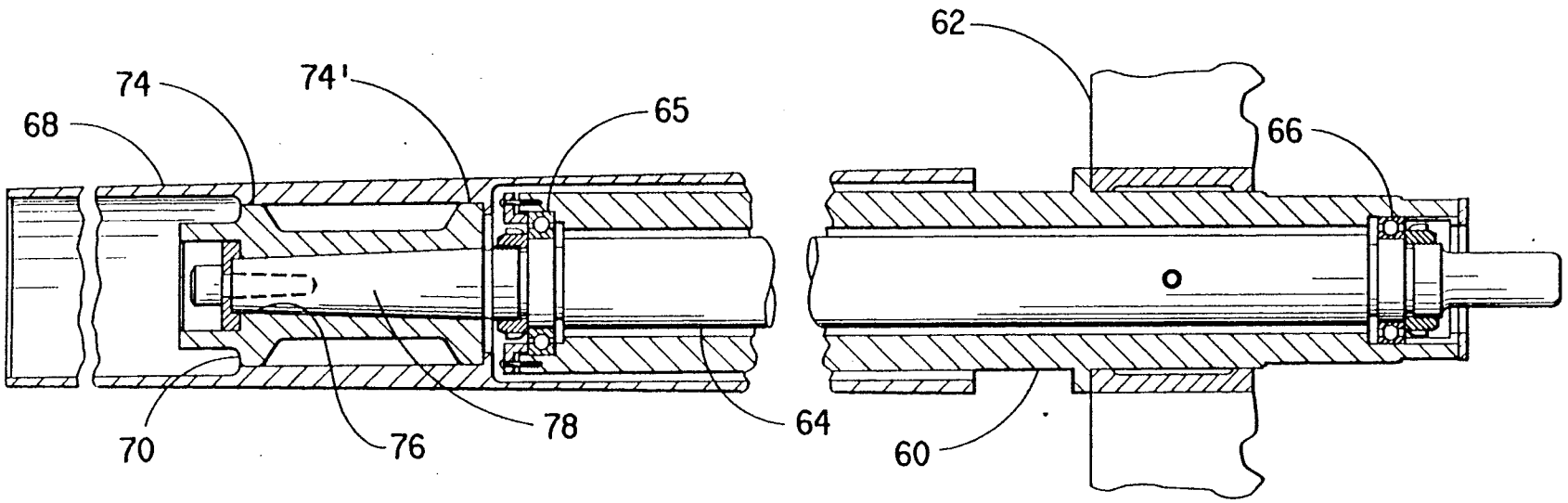
FIG. 2 (PRIOR ART)
FIG. 2 is a cross-section of an existing, previously used drive roll assembly.

FIG. 2 depicts an existing previously used drive roll assembly that can be replaced by the assembly of this invention. The drive roll assembly of FIG. 2 has rigid support 60 attached to winder frame 62. Rotationally driven shaft 64 is supported at the outboard end of support 60 by bearing 65 and at its inboard end by bearing 66. Drive shell 68 is attached to shaft 64 by hub 70. Shaft 64 and attached shell 68 are driven through shaft 64 by means of a conventional system of motor-driven belts and pulleys (not shown) located behind frame 62 away from the winding yarn packages. Drive roll shell 68 is permanently attached at 74 and 74' to hub 70 which has a tapered bore 76. Final machining of the outer diameter of shell 68 is done after assembly of hub 70 to shell 68 to assure concentricity of the assembly. As the shell is made longer, fabrication of the assembled parts becomes more difficult and expensive and excessive deflection of shell 68 and support 60 occurs. In addition, it becomes difficult to get tools into the center portion of the longer shell to disengage locking tapered end 78 for assembly and disassembly of shell 68 from drive shaft 64.

Figure 3:
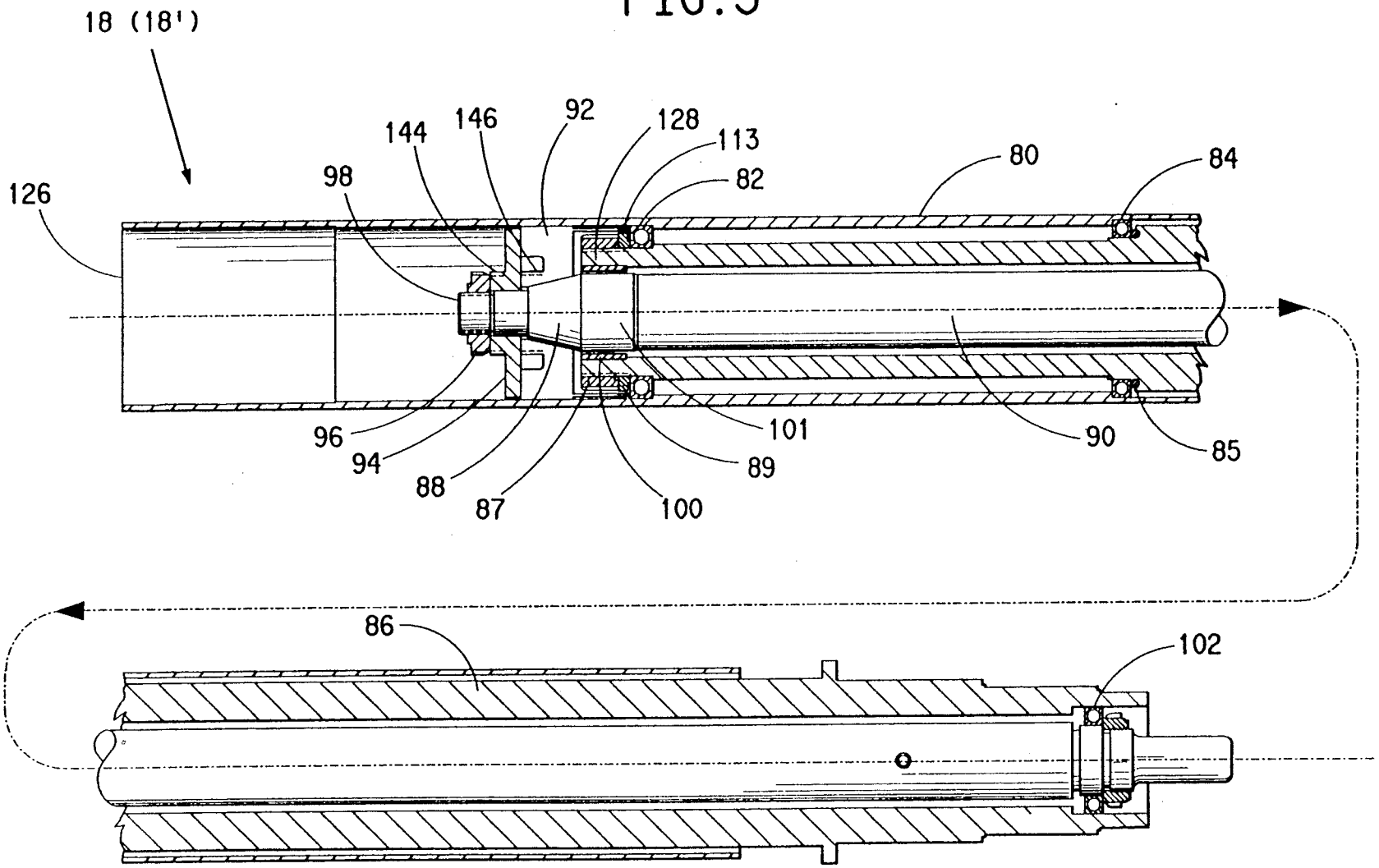
FIG. 3 is a cross-section of a drive roll assembly in accordance with the present invention.
Figure 4:
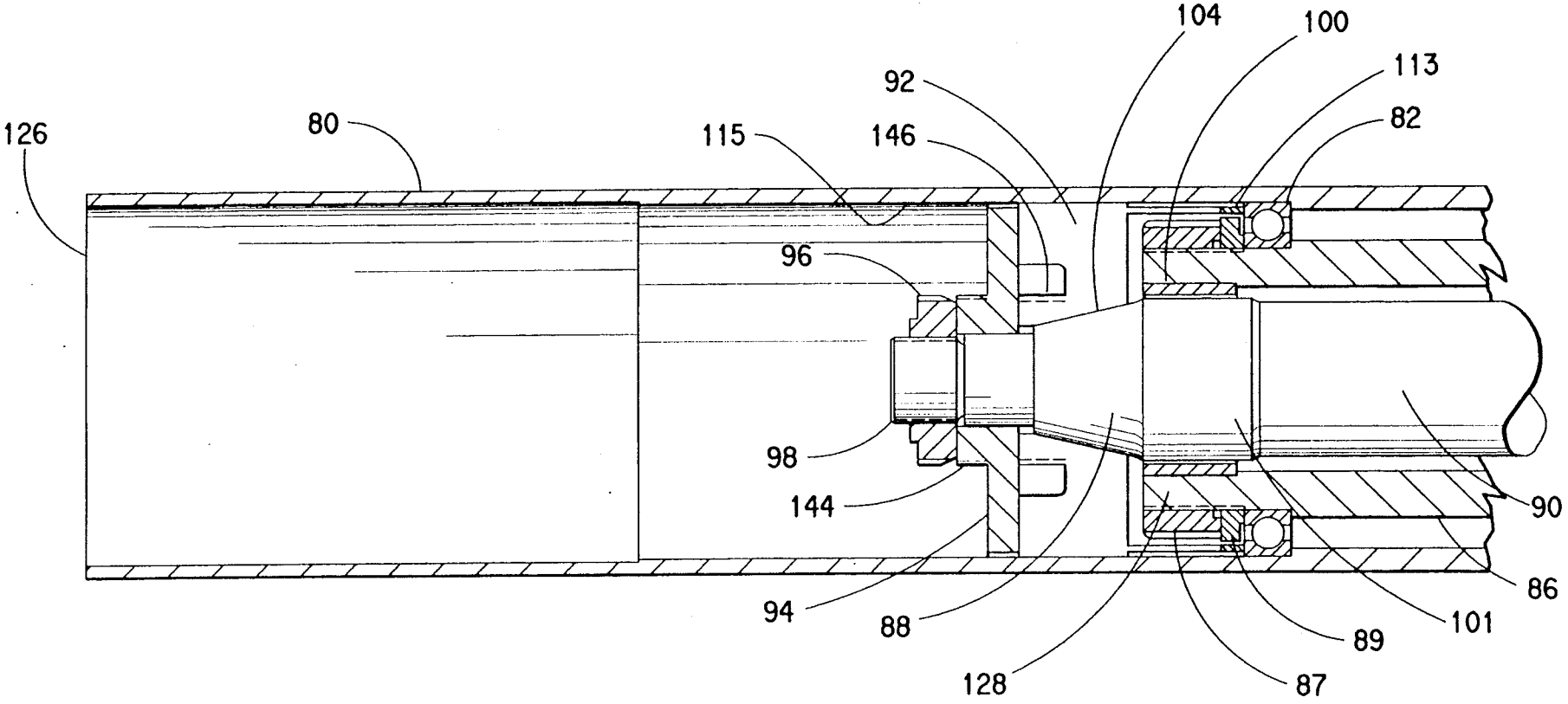
FIG. 4 is an enlarged view of outboard end of the drive roll assembly of FIG. 3.

FIG. 3 presents a cross-section of the stiffer, higher speed, drive roll assembly of the invention and FIG. 4 is an enlarged view of the outboard end (left end) of the assembly. Shell 80 is supported by spaced bearings 82 and 84 at two points on support fitting 86 instead of at one drive-shaft support point (65) as in the previously used drive roll assembly of FIG. 2. In contrast to the drive roll assembly of FIG. 2, shaft 90 has a smaller cross-section. Shaft 90 is no longer required to support shell 80 and support 86 has a correspondingly larger cross-section which results in a stiffer support for the assembly. Bearings 82 and 84 are rigidly mounted in shell 80 and slideably engage support 86. Bearing 82 is held in place by nut 87 and washer 89. Bearing 84 is forced toward bearing 82 by compressed elastomeric "O"-ring 85 which preloads the bearing assemblies and minimizes vibration during operation. Tapered end 88 of drive shaft 90 is coupled to shell 80 by deflectable coupling 92 and compression plate 94 which makes up part of the coupling assembly. Coupling 92 can be readily detached from shell 80 for shell replacement. Rotational torque is transmitted from driven shaft 90 to shell 80 by frictional engagement of the outer surface of tapered shaft end 88 with the tapered bore of coupling 92 and frictional engagement of the outer surface of deflectable coupling 92 with the inner surface of shell 80. This friction is produced by pulling tapered shaft end 88 into the tapered bore of the coupling to produce a high force outward against the inner surface of shell 80. Nut 96 which engages threaded shaft end 98 and bears on plate 94 forces coupling 92 and tapered shaft end 88 together. In addition to shell support bearings 82 and 84, bushing 100 which is rigidly mounted in support fitting 86 and engages collar 101 on shaft 90 provides initial alignment of shaft end 88 with coupling 92. Bearing 102, which is rigidly mounted on shaft 90 and able to slide in support 86, radially supports shaft 90 at the inboard end of support 86. Nut 96 pulls shaft 90 into engagement with coupling 92, so that collar 101 of shaft 90 radially clears bushing 100 and the outboard end of the shaft is supported by only bearing 82.

Figure 5:
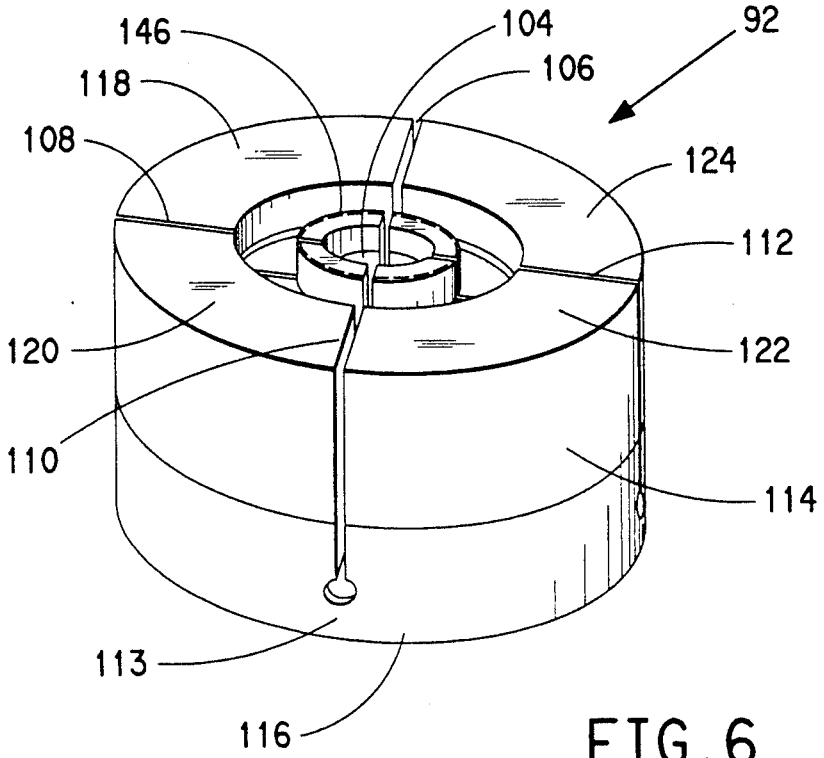
FIG. 5 is a detail perspective drawing of a coupling of the drive roll assembly depicted in FIGS. 3 and 4, the coupling having deflectable segments 118, 120, 122 and 124.

One embodiment of deflectable coupling 92 is shown in more detail in FIG. 5. The coupling, made from a single piece of rigid material, such as aluminum, has tapered (conical) axial bore 104 and radial cuts 106, 108, 110, and 112 and deflectable segments 118, 120, 122, and 124, which segments are connected to annular web 113. The cuts extend through most of the length of coupling 92 so that the deflectable segments can deflect radially during assembly of the coupling with shell 80 and tapered end 88 of shaft 90. In manufacturing coupling 92, before the cuts are made, outside diameter 114 is machined precisely to match inner diameter 115 of drive roll shell 80. Outer diameter 116, at the end of coupling 92 in which there are no radial cuts, is smaller than diameter 114 for clearance with the shell. Accurate machining of the drive roll shell and coupling avoids vibration during operation and permits interchangeability of drive roll shells without requiring custom balancing and alignment.

Tapered bore 104 of coupling 92 is machined to a self-locking or Steep Machine taper fit with end 88 of the drive shaft 90. The self-locking taper assures considerable frictional resistance to any force that might turn or rotate coupling 92 relative to drive shaft 90. American National Standard Steep Machine Tapers, ANSI B5.10-1963, as listed in Obery et al., "Machinery's Handbook", 21st ed., Industrial Press, Inc., N.Y., Table 6, page 1733, (1980), are suited for use in the roll assemblies of the invention. ANSI Steep Taper No. 30 is preferred. Compression plate 94 is attached to outboard end 98 of drive shaft 90 to retain coupling 92 in place. Locknut 96 threads onto end 98 of drive shaft 90 and when tightened locks tapered end 88 of the shaft into tapered bore 104 of the coupling.

Figure 10:
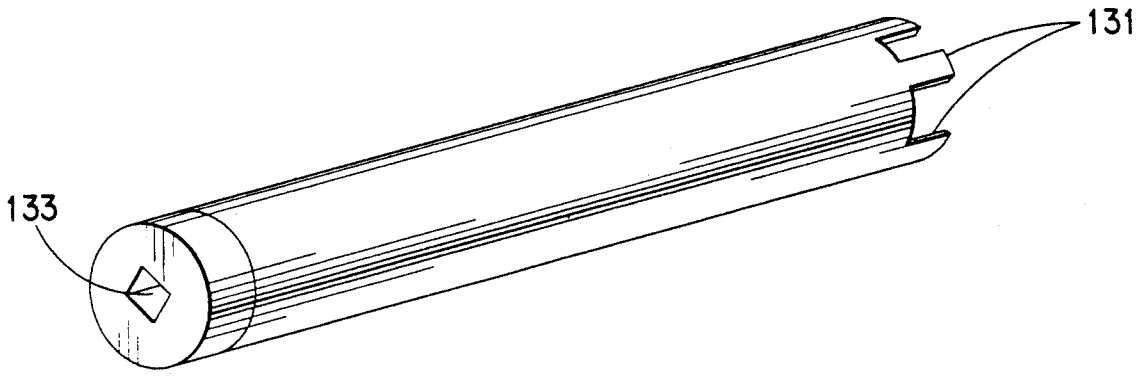

When assembling coupling 92 with drive roll shell 80, bearings 82 and 84 are attached to the shell. Drive shaft 90 is removed or retracted slightly in the support 86. The thusly formed dried roll shell and bearings assembly is slid over support 86. Washer 89 is slipped over support 86 and nut 87 is threaded onto threaded end 128 of support 86. FIG. 10 shows a tool useful for reaching inside drive shell 80 to turn nut 87, which has slots that match prongs 131 of the tool. When tightened, nut 87 forces bearing 82 against a shoulder on the end of support 86. Coupling 92 is then gently inserted and slid into drive shell outboard end 126 until annular web 113 abuts bearing 82. Radial cuts 106, 108, 110, and 112 allow deflectable segments 118, 120, 122, and 124 to deflect inward for easy sliding inside the shell. Drive shaft 90 is then slid through support 86 until end 88 seats inside bore 104 of coupling 92. Compression plate 94 is slid over end 98 of the shaft and locknut 96 is threaded on until tapered end 88 of shaft 90 is drawn up tightly inside tapered bore 104. This produces a high force between the outer surfaces of segments 118, 120, 122, and 124 and the inner diameter 115 of the drive roll shell. Because the coupling outer diameter and drive shell inner diameter are machined to be substantially the same, good surface contact and high friction forces are established between the coupling and shell.

Figure 6:
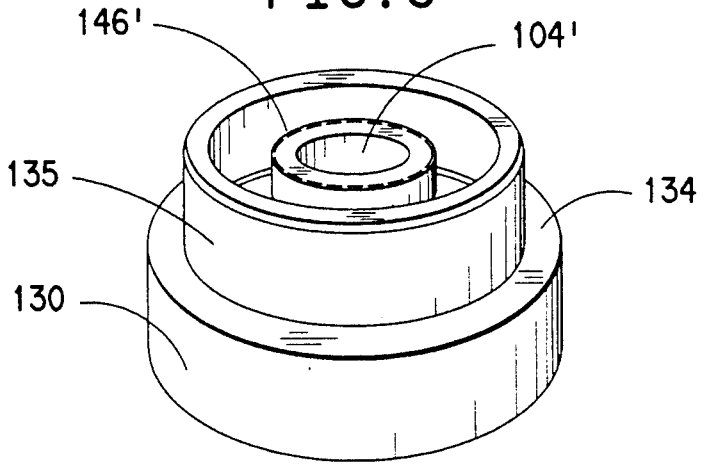
FIGS. 6 and 7 are detail perspective drawings of another coupling according to the invention comprising collar 130 and an elastomeric ring 132.
Figure 7:
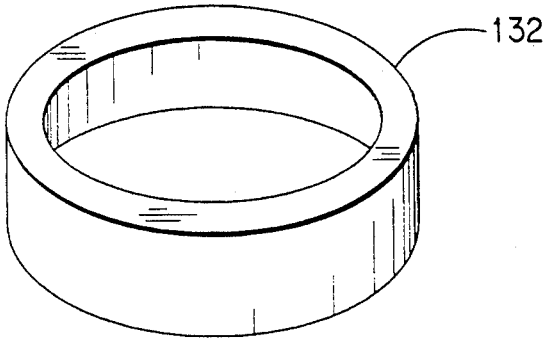
Figure 8:
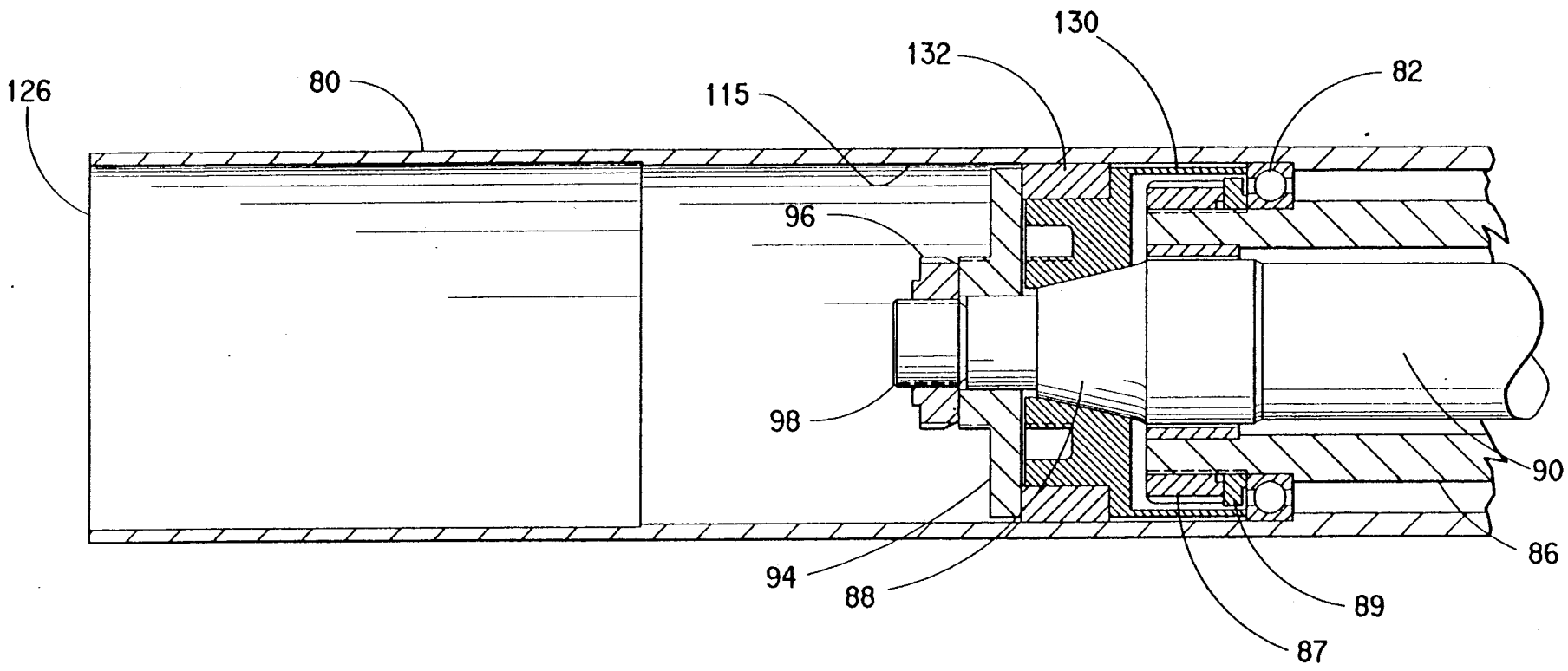
FIG. 8 is an enlarged cross-section of the outboard end of the drive roll assembly of the invention in which the coupling of FIGS. 6 and 7 are used.

FIGS. 6, 7 and 8 depict another embodiment of a deflectable coupling suitable for use in drive roll assemblies of the invention. The coupling has metal collar 130 and steep machined taper bore 104'. The bore engages tapered end 88 of shaft 90 in the same manner as the coupling of FIG. 5. An elastomeric ring 132 fits closely on collar 130 and seats against surface 134. The outside diameter of elastomeric ring 132 is of slightly smaller diameter than inside diameter 115 of shell 80. Compression plate 94 seats against elastomeric ring 132 and makes up part of the coupling assembly. Locknut 96 threads onto outboard end 98 of drive shaft 90 and when tightened compresses elastomeric ring 132 between compression plate 94 and metal collar surface 134. The compression causes elastomeric ring 132 to expand uniformly and tightly grip inner surface 115 of shell 80 while gripping outer surface 135 of collar 130. Various elastomeric materials, such as neoprene or "VITON" fluoroelastomer, manufactured by E. I. du Pont de Nemours & Co., are suitable for the elastomeric ring.

Figure 9:
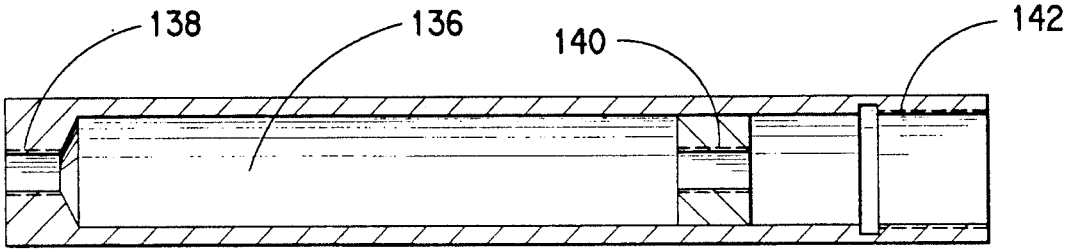
FIGS. 9 and 10 depict tools especially adapted for assembling and disassembling drive roll assemblies of the invention.

Disassembly and reassembly procedures for the drive roll assemblies of the invention are simplified by use of the specifically designed tools of FIGS. 9 and 10. For example, if the drive roll assembly is in the fully assembled condition as shown in FIGS. 3 and 4, locknut 96 can be removed first with a tool as illustrated in FIG. 10. The tool, which is sized for nut 96, is fitted onto a conventional ratchet at 133 and inserted into outboard end 126 of drive roll shell 80. Prongs 131 engage locknut 96 for loosening and removing the nut. To remove compression plate 94, the tool of FIG. 9 is fitted with a lead screw (not shown) through interior 136, engaging threads 138 and 140. Threads 142 on the tool are then threaded onto threads 144 of compression plate 94. The lead screw is rotated to bear against outboard end 98 of drive shaft 90 and compression plate 94 is urged from drive shaft 90 and removed from the interior of shell 80. After compression plate 94 is removed from the tool, the tool is reused to remove coupling 92 in a similar manner. Tool threads 142 engage coupling threads 146. Advancing the lead screw causes coupling 92 to break free of tapered end 88 of drive shaft 90. Finally, bearing locknut 87 is removed with the tool of FIG. 10. Drive roll shell 82 and shaft 90 can then be easily removed from support 86.

We claim:

1. In a drive roll assembly, particularly suited for high speed winding of a plurality of threadlines on an equal number of separable yarn packages which are supported on a common cantilevered chuck, the drive roll rotating the yarn packages by direct contact to the drive roll surface with the periphery of the packages, said drive roll assembly having an elongated tubular shell having a cylindrical inner surface and an outer drive surface, an elongated tubular support fitting which extends coaxially inside one end of the shell for a portion of the fitting length, said fitting having an inboard end adapted for cantilevered attachment to a supporting wall of a winding apparatus, a drive shaft coaxially located inside the support fitting and having an outboard portion that extends into a portion of the tubular shell, the shaft extending from outside the inboard end of the support fitting to beyond the outboard end of the support fitting and being supported radially at least at the inboard end of the fitting, the improvement comprising two spaced bearings rigidly mounted on the inner surface of the shell and contacting the outer surface of the support fitting for rotatably supporting the shell on the support, with one bearing positioned at the outboard end of the support fitting and a radially deflectable coupling assembly located inside the shell, attached to the outboard end of the drive shaft and having an outer cylindrical surface that frictionally engages a portion of the inner cylindrical surface of the tubular shell, so that the outboard portion of the shaft is rotatably supported by only the bearing supporting the shell at the outboard end of the support fitting.

2. A drive roll assembly in accordance with claim 1 wherein the improvement further comprises means for applying an axial force between the coupling assembly and the end of the shaft to develop radial forces between the inner surface of the shell and the outer surface of the coupling assembly.

3. A drive roll assembly in accordance with claim 2 wherein the outboard end of the drive shaft has a tapered outer surface and a threaded portion, the coupling assembly is radially expansible and has a tapered bore which matches the tapered outer surface of the drive shaft, and a nut engages the threaded portion of the drive shaft and bears against the coupling assembly to move the tapered bore of the coupling assembly relative to the tapered outer surface of the drive shaft thereby expanding the coupling assembly into engagement with the inner surface of the shell.

4. A drive roll assembly in accordance with claim 3 wherein the coupling assembly has radial cuts extending along a major fraction of the length of the coupling assembly and forming radially deflectable segments which have an outer diameter that equals the diameter of a portion of the inner surface of the shell, and the bore of the coupling assembly has a steep machine taper matching the taper of the outboard end of the drive shaft.

5. A drive roll assembly in accordance with claim 3 wherein the deflectable coupling assembly comprises a collar having a shoulder on which is seated an annular elastomeric ring and a compression plate which bears against the elastomeric ring whereby the nut forces the plate against the ring and forces the elastomeric ring into pressing frictional engagement with the collar and the shell inner surface.

* * * * *